US010220489B2

(12) United States Patent
Rampling

(10) Patent No.: US 10,220,489 B2
(45) Date of Patent: Mar. 5, 2019

(54) TOOL FOR CONDITIONING A BLADE OF A PLASTERING TOOL

(71) Applicant: SCOTT CUTTERS LIMITED, Marlow, Buckinghamshire (GB)

(72) Inventor: Scott Rampling, Marlow (GB)

(73) Assignee: Scott Cutters Limited (GB)

( * ) Notice: Subject to any disclaimer, the term of this patent is extended or adjusted under 35 U.S.C. 154(b) by 38 days.

(21) Appl. No.: 15/517,853

(22) PCT Filed: Sep. 10, 2015

(86) PCT No.: PCT/GB2015/052613
§ 371 (c)(1),
(2) Date: Apr. 7, 2017

(87) PCT Pub. No.: WO2016/038369
PCT Pub. Date: Mar. 17, 2016

(65) Prior Publication Data

US 2017/0259404 A1 Sep. 14, 2017

(30) Foreign Application Priority Data

Sep. 12, 2014 (GB) ..... 1416160.8

(51) Int. Cl.
*B24D 15/02* (2006.01)
*B24D 15/06* (2006.01)

(52) U.S. Cl.
CPC ..... *B24D 15/02* (2013.01); *B24D 15/06* (2013.01)

(58) Field of Classification Search
CPC ..... B24D 15/02; B24D 15/06
USPC ..... 451/461, 552–557
See application file for complete search history.

(56) References Cited

U.S. PATENT DOCUMENTS

| | | | | | |
|---|---|---|---|---|---|
| 347,506 | A | | 8/1886 | George | |
| 1,608,841 | A | * | 11/1926 | De Canio | B24D 15/00 451/461 |
| 2,871,729 | A | | 2/1959 | Schoonover | |
| 4,494,340 | A | * | 1/1985 | Carter | B24D 15/085 451/164 |
| 4,498,360 | A | | 2/1985 | Milum | |
| 4,696,129 | A | * | 9/1987 | Roberts | B24D 15/081 451/555 |
| 5,157,879 | A | * | 10/1992 | Fletcher | B24D 15/06 451/45 |
| 5,195,277 | A | * | 3/1993 | Courchesne | B24D 15/06 451/45 |
| 5,224,302 | A | * | 7/1993 | Grossi | A63C 3/10 451/45 |

(Continued)

FOREIGN PATENT DOCUMENTS

NZ 333598 A 11/2001

OTHER PUBLICATIONS

PCT International Search Report and Written Opinion dated Feb. 2, 2016.

(Continued)

*Primary Examiner* — George B Nguyen
(74) *Attorney, Agent, or Firm* — Gearhart Law, LLC

(57) ABSTRACT

A tool for conditioning a plastic blade of a plastering tool, the tool comprising a first guide means and a conditioning blade, wherein the first guide means is arranged to receive an edge portion of the plastering tool blade for guiding movement of the plastering tool blade relative to the conditioning blade.

19 Claims, 2 Drawing Sheets

(56) References Cited

U.S. PATENT DOCUMENTS

| | | | | | |
|---|---|---|---|---|---|
| 5,291,805 | A | | 3/1994 | Byers et al. | |
| 5,478,272 | A | * | 12/1995 | Cozzini | B24D 15/10 451/555 |
| 5,879,229 | A | * | 3/1999 | Anderson | B24D 15/066 451/523 |
| 5,885,035 | A | | 3/1999 | Hoffschneider | |
| 5,941,761 | A | * | 8/1999 | Nagahara | B24D 15/081 451/486 |
| 6,017,267 | A | * | 1/2000 | Ariza | B24B 53/017 451/444 |
| 6,074,293 | A | * | 6/2000 | Bleier | B24D 15/02 428/119 |
| 7,503,241 | B2 | * | 3/2009 | Dassaud | B24D 15/081 451/486 |
| 8,221,199 | B2 | * | 7/2012 | Smith | B24B 3/54 451/461 |
| 2003/0134583 | A1 | | 7/2003 | Gallegos et al. | |
| 2004/0014415 | A1 | * | 1/2004 | Stallegger | B24B 3/605 451/321 |
| 2005/0197053 | A1 | * | 9/2005 | Fierus | B24D 15/081 451/555 |

OTHER PUBLICATIONS

UK Combined Search and Examination Report GB1414160.8, dated Feb. 18, 2015.

* cited by examiner

TOOL FOR CONDITIONING A BLADE OF A PLASTERING TOOL

This application is a U.S. national phase application of PCT-application PCT/GB2015/052613 filed on Sep. 10, 2015, which claims priority of Great Britain national application number 1416160.8 which was filed on Sep. 12, 2014, both disclosures of which are incorporated herein by reference.

The present disclosure relates to a tool, in particular to a tool that is suitable for conditioning a plastic blade of a plastering tool, such as a plaster trowel suitable for smoothing and levelling wet finish coat plaster applied to a surface such as a wall or ceiling.

Conventionally, plaster is applied to walls and ceilings using a plaster trowel which comprises a flat rectangular sheet (otherwise referred to as a 'blade') having dimensions of about 280 mm to 460 mm by 120 mm with a generally cylindrical handle mounted spaced from and parallel to the sheet. The same tool is used for smoothing and levelling the plaster once it has been applied.

Conventionally, the blades of plaster trowels were formed from metal, however, plastic bladed plaster trowels have become increasingly popular with plasterers, as an alternative method of finishing the plasterwork.

Plastic bladed trowels do, however, suffer the disadvantage that the blade is more prone to damage, such as nicks to the edges of the blade. It is crucial for achieving a good finish that the edge of the blade is straight and smooth, which means that generally once a blade is damaged it must be discarded, since filing or sanding the edge of the blade to remove the damage invariably ends with a blade that has a slightly curved or imperfect edge unsuitable for finishing the plasterwork.

The present invention arose in a bid to provide a tool that will enable accurate conditioning of a blade following damage or otherwise.

According to the present invention in a first aspect, there is provided a tool for conditioning a plastic blade of a plastering tool, the tool comprising a first guide means and a conditioning blade, wherein the first guide means is arranged to receive an edge portion of the plastering tool blade for guiding movement of the plastering tool blade relative to the conditioning blade, wherein the conditioning blade is curved, so that a curved profile is applied to the edge of the plastering tool blade.

According to the present invention in a further aspect, there is provided a tool for conditioning a plastic blade of a plastering tool, the tool comprising a first guide means and a conditioning blade, wherein the first guide means is arranged to receive an edge portion of the plastering tool blade for guiding movement of the plastering tool blade relative to the conditioning blade. The blade may be straight or curved.

The first guide means may comprise an elongate channel extending along the length of the tool, the elongate channel being arranged such that an edge portion of the plastering tool blade may be received by the channel in a slack fit which permits sliding movement of the edge portion of the plastering tool blade along the channel, and the conditioning blade is mounted in or adjacent to the channel.

By the provision of a guide means and a conditioning blade together, it is possible to shave the edge from a plastering tool, thus removing nicks or other damage, whilst ensuring that the edge of the plastering tool remains straight.

A working portion of the guide means extending straight and guiding the plastering tool blade through its interaction with the blade.

The tool preferably comprises a second guide means and an abrasive element, wherein the second guide means is arranged to receive an edge portion of the plastering tool blade for guiding movement of the plastering tool blade relative to the abrasive element.

By the provision of a guide means and an abrasive element together, it is possible to finish and smooth the edge of a plastering tool to provide a desired edge profile, whilst again ensuring that the edge of the plastering tool remains straight. A working portion of the guide means extending straight and guiding the plastering tool blade through its interaction with the abrasive element.

Further, preferable, features are presented in the dependent claims.

Non-limiting embodiments will now be described, by way of example only, with reference to the accompanying drawings, in which.

Figure 1:
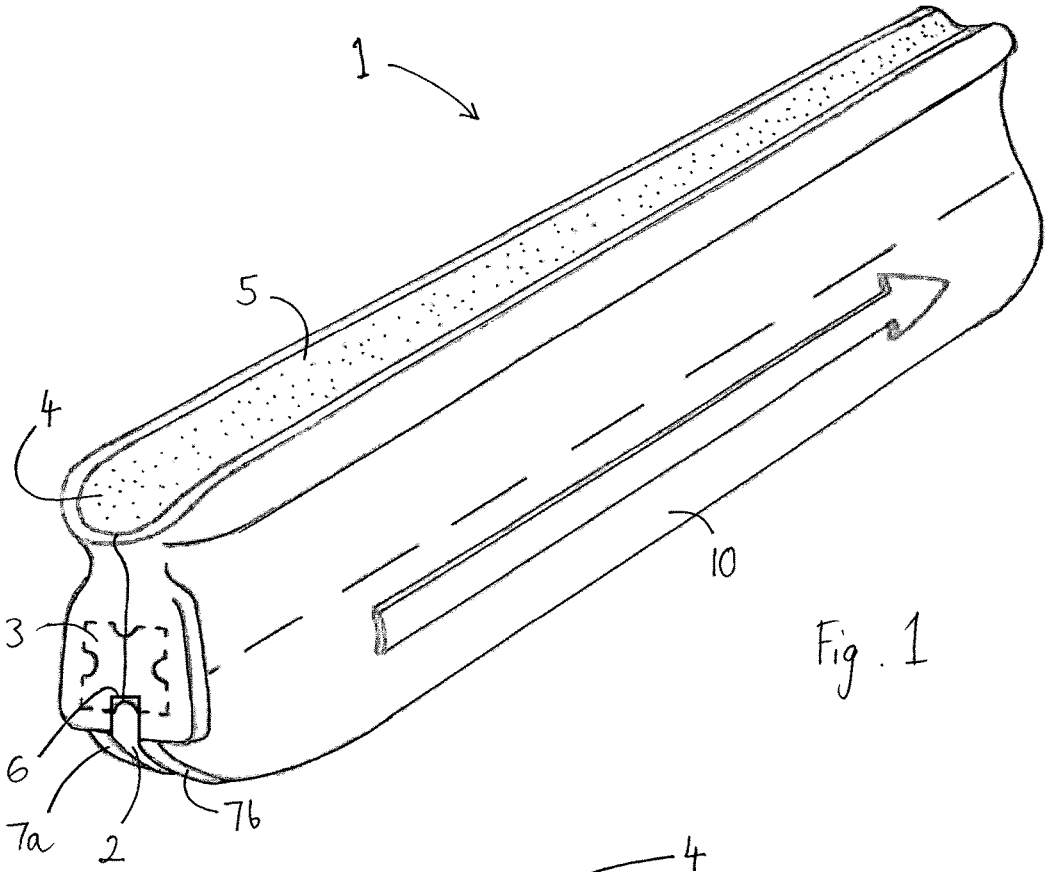
FIG. 1 shows a tool for conditioning a plastic blade of a plastering tool according to a first embodiment in perspective view.
Figure 2:
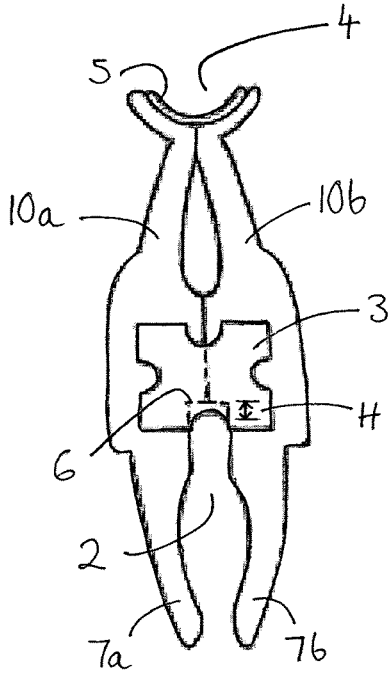
FIG. 2 shows a partial sectional end view of the tool of FIG. 1 taken through the blade of the tool.
Figure 3:
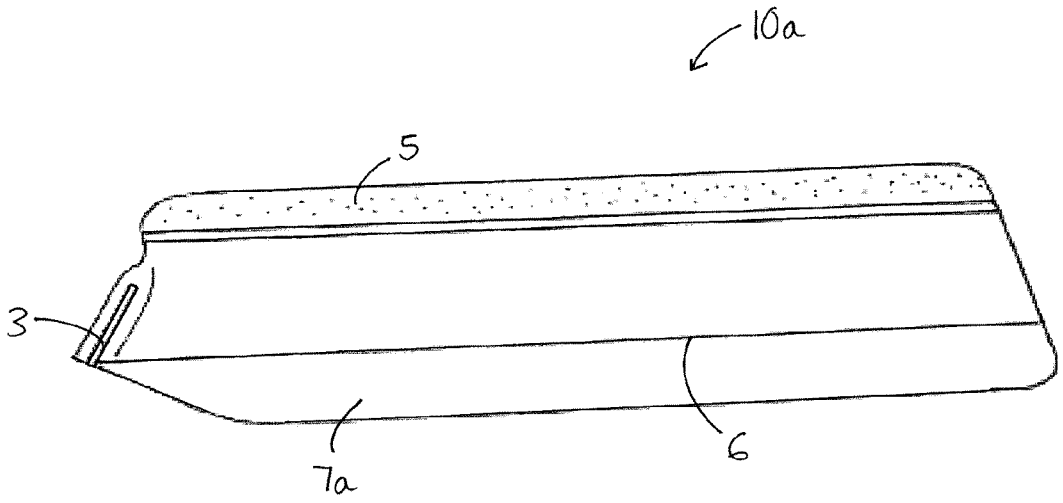
FIG. 3 shows a side view of one half of the tool of FIG. 1.

With reference to FIGS. 1 to 3, there is shown a tool 1 for conditioning a plastic blade of a plastering tool (not shown), which comprises: a first guide means, which comprises an elongate channel 2, and an associated conditioning blade 3; and a second guide means, which comprises an elongate groove 4, and an associated abrasive element 5.

The channel 2 is arranged such that an edge portion of the plastering tool blade may be received by the channel in a slack fit which permits sliding movement of the edge portion of the plastering tool blade along the channel 2. The channel 2 thereby guides movement of the plastering tool blade relative to the conditioning blade 3, which is mounted in the channel 2. The elongate groove 4 is arranged to receive an edge portion of the plastering tool blade for guiding movement of the plastering tool blade relative to the abrasive element 5.

It should be noted that the plastering tool to be conditioned may be pushed or pulled across the conditioning blade 3 during use of the tool.

The blade 3 allows for the removal of nicks or other damage from a plastering tool blade by shaving material from the blade. The abrasive element allows for the smoothing of the blade, generally after the blade has been shaved/repaired.

The tool 1 is arranged to be grasped one handed, with a plastering tool (not shown) grasped in the other hand, wherein the plastering tool may be engaged with the tool 1 and the tool 1 and plastering tool can be moved relative to one another is a sliding motion.

In simplified arrangements, the elongate groove 4 and abrasive element 5 may be omitted.

It is preferable, as shown, that the tool comprises a main body 10. The main body is most preferably formed from plastic. It may be moulded or extruded or otherwise formed, as will be readily appreciated by those skilled in the art. It may be formed unitarily, i.e. as a single piece. More preferably, however, it will be formed in multiple parts. In the present arrangement it is formed in two halves 10*a*, 10*b* as shown. The main body may be arranged such that it can be separated into two parts for cleaning or the replacement of the blade 3. Alternatively, the two halves may be permanently attached to one another, by ultra-sonic welding or otherwise.

The channel 2 preferably extends (in the longitudinal direction) along substantially the entire length of the tool 1 and is preferably open at both of its ends. It is preferable that the channel 2 is open at both of its ends, since not only is it then easy to engage the plastering tool blade with the channel 2, and to pass the plastering tool over the blade 3, but also it is easy to clean out swarf or other residue that may collect in the channel 2 during use. In alternative arrangements, however, the channel 2 may be closed at its end distal to the blade 3.

The channel 2 comprises a base 6 against which the edge of the plastering tool blade may be slid. The base in the present arrangement is straight across its width and along its entire length. Moreover, the channel 2 is square adjacent the base 6 with side walls 7*a*, 7*b* of the channel, upstanding from either side of the base, extending away from the straight base perpendicular thereto, as seen in FIG. 2. In alternative arrangements the base 6 may be curved or otherwise shaped in the width direction and/or the portions of the side walls 7*a*, 7*b* adjacent the base may other than straight as they extend away from the base or may be angled toward one another.

The conditioning blade 3 extends across the entire width of the base at a predetermined height above the level of the base 6. In the present arrangement the blade has a curved profile across the width of the base, as seen in FIGS. 1 and 2, such that a curved edge will be applied to the plastering tool blade. In alternative arrangements the blade may be straight, i.e. may extend parallel to the base when the base is also straight. The predetermined height of the blade above the base may, for example, be 0.05 to 0.2 mm. When the blade is curved, the maximum height H of the blade above the base may be 0.05 to 0.2 mm. The curvature or shape may be varied to achieve desired edge profiles with a range of blades available.

The blade is positioned at or adjacent to a first end of the channel 2 in the longitudinal direction. It may be located at a point along the length of the channel 2 or may be located beyond the channel. Various positions will be suitable for the blade 3 to perform its task of shaving material from the edge of the blade of the plastering tool. The blade may be metal. It may, for example be formed from tungsten or stainless steel. It may alternatively be formed from a ceramic material. A range of suitable blade materials will be readily appreciated by those skilled in the art.

Figure 4:
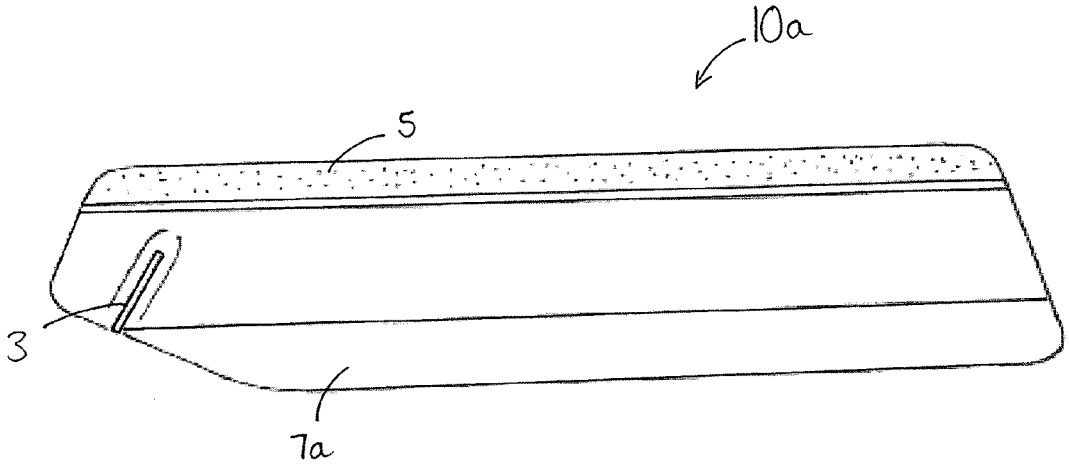
FIG. 4 shows a side view of one half of a tool according to further embodiment.

The blade may be oriented perpendicular to a longitudinal axis of the channel 2 (and tool 1) or may be provided at an oblique angle thereto. The views of FIGS. 3 and 4 show the blade oriented at an oblique angle. When the blade is provided at an oblique angle, the working edge of the blade may be square, when viewed as in FIG. 3 or 4. When the blade is perpendicular, the working edge of the blade may taper to a point, when viewed as in FIG. 3 or 4.

In alternative arrangements, rather than the base being straight across its entire length, it may have a stepped arrangement with a first level that is straight in the longitudinal direction and a second level that is higher than the first level and is straight in the longitudinal direction. Here the blade will extend above the first level to the height of the second level, such that the working edge of the blade is at the same level as the second level of the base. In such an arrangement, the first level of the base guides the plastering tool blade to the blade and the second level of the base guides the plastering tool beyond the blade. The difference in height between the first and second levels may be 0.05 to 0.2 mm, in accordance with the discussion above. Such an arrangement provides additional support to the blade. In such an arrangement, the blade may be spaced inwardly from a longitudinal edge of the channel by a greater distance than in the other arrangements described herein. It may be around a mid-point of the channel. All other features/alternatives discussed herein remain applicable to this alternative arrangement.

FIG. 3 shows a side view of one half 10*a* of the tool body of FIGS. 1 and 2. FIG. 4 shows an alternative arrangement to FIG. 3 in which the housing of the tool is extended further beyond the first end of the groove 2 and the blade 3. As with FIG. 3, one half 10*a* of the tool body is shown in FIG. 4.

In both the arrangements of FIGS. 3 and 4, the walls 7 of the channel 2 at their ends adjacent the blade are tapered away from the blade. With such an arrangement, the height of the channel is reduced adjacent the blade making it easy for a user to access the area around the blade for clearing any debris or swarf around the blade using a suitable tool or finger. In this regard, it should be noted that since the blade is arranged to shave plastic from plastering tool blades, it need not necessarily be formed such that it will pose a hazard to a user putting their finger in the channel. Whilst a taper is shown in both arrangements, the walls could instead be stepped. Moreover, as suggested above, the blade could be positioned outside the channel, i.e. beyond the end of the channel, wherein the channel will suitably provide its guiding function and the area around the blade will be freely accessible for clearing debris and swarf.

In both FIGS. 3 and 4 the blade 3 is shown to be received in a suitably moulded/machined groove. This is a preferred mounting means. Alternative arrangements will, however, be appreciated by those skilled in the art. The blade 3, as discussed above and as shown, is provided at an oblique angle to the longitudinal direction of the base with its edge at the predetermined height above the base 6.

In the arrangement of FIG. 4 with the blade seating area set in from the first end of the tool 1 in the longitudinal direction, which may, for example, be up to 15 mm to 40 mm, provision is made for a user to grip with forefinger and index finger at the end of the tool to pull the tool across the plastering tool blade.

The side walls 7*a*, 7*b*, as seen in FIG. 2, are bowed outward in the width direction as they extend away from the base 6 to their distal ends. They may be otherwise arranged. For example, they could be straight and angled toward one another as they extend away from the base. A spacing between the ends of the walls 7*a*, 7*b* distal to the base may be smaller than the width of the base. Regardless of their form, the ends of the walls distal to the base 6 are preferably resiliently biased towards one another to grip the blade of the plastering tool, making the tool suitable for use with a range of plastering tool blades having different thicknesses. For example, the tool may offer a perceived snug fit to plastering tool blades between 1 mm and 6 mm thick. The side walls 7*a*, 7*b* are most preferably formed from an inherently resilient material.

The elongate groove 4 is curved in the width direction and straight in the longitudinal direction. It may be curved across its entire width as seen in FIG. 2 and straight along its entire length as seen most clearly in FIGS. 3 and 4. It is shallower and wider than the groove 2, although need not be. It preferably extends along substantially the entire length of the tool 1 and is preferably open at both of its ends. It may, however take alternative forms, as will be readily appreciated by those skilled in the art. In the present arrangement, substantially the entire surface of the groove 4 is covered with sand paper 5, or a similar abrasive sheet material, which may be adhered to the surface of the groove 4, or otherwise attached.

What is claimed is:

1. A tool for conditioning a plastic blade of a plastering tool, the tool comprising a first guide means and a conditioning blade, wherein the first guide means is arranged to receive an edge portion of the plastering tool blade for guiding movement of the plastering tool blade relative to the conditioning blade, wherein the conditioning blade is curved, so that a curved profile is applied to the edge of the plastering tool blade, wherein the first guide means comprises an elongate channel, which is arranged such that an edge portion of the plastering tool blade may be received by the channel in a slack fit which permits sliding movement of the edge portion of the plastering tool blade along the channel, and the conditioning blade is mounted in or adjacent to the channel.

2. A tool as claimed in claim 1, wherein a first end of the channel is open to permit sliding travel of the edge portion of the plastering tool blade out of the channel, and the conditioning blade is mounted at or adjacent to the first end of the channel.

3. A tool as claimed in claim 2, wherein a second end of the channel is open to permit sliding travel of the edge portion of the plastering tool blade into the channel.

4. A tool as claimed in claim 1, wherein the elongate channel extends along substantially the entire length of the tool.

5. A tool as claimed in claim 1, wherein the channel comprises a base, against which the edge of the plastering tool blade may be slid, the base being straight in the longitudinal direction along at least a portion of its length, and the conditioning blade extends across the width of the base at a predetermined height above the level of the base.

6. A tool as claimed in claim 5, wherein the base is straight along its entire length.

7. A tool as claimed in claim 5, wherein the base is substantially planar or is curved in its width direction.

8. A tool as claimed in claim 5, wherein the channel comprises a pair of walls upstanding from either side of the base, wherein the ends of the walls distal to the base are resiliently biased towards one another.

9. A tool as claimed in claim 8, wherein the walls are formed from an inherently resilient material.

10. A tool as claimed in claim 1, wherein the conditioning blade is perpendicular to a longitudinal axis of the guide means.

11. A tool for conditioning a plastic blade of a plastering tool, the tool comprising a first guide means and a conditioning blade, wherein the first guide means is arranged to receive an edge portion of the plastering tool blade for guiding movement of the plastering tool blade relative to the conditioning blade, wherein the conditioning blade is curved, so that a curved profile is applied to the edge of the plastering tool blade, wherein the conditioning blade is at an oblique angle to a longitudinal axis of the guide means.

12. A tool for conditioning a plastic blade of a plastering tool, the tool comprising a first guide means and a conditioning blade, wherein the first guide means is arranged to receive an edge portion of the plastering tool blade for guiding movement of the plastering tool blade relative to the conditioning blade, wherein the conditioning blade is curved, so that a curved profile is applied to the edge of the plastering tool blade, the tool further comprising a second guide means and an abrasive element, wherein the second guide means is arranged to receive an edge portion of the plastering tool blade for guiding movement of the plastering tool blade relative to the abrasive element.

13. A tool as claimed in claim 12, wherein the second guide means comprises an elongate groove having a curved or shaped profile.

14. A tool as claimed in claim 13, wherein the abrasive element covers the entire surface of the groove.

15. A tool as claimed in claim 12, wherein the abrasive element comprises sand paper.

16. A tool as claimed in claim 13, wherein the groove is open at its ends.

17. A tool as claimed in claim 13, wherein the groove extends along substantially the entire length of the tool.

18. A tool as claimed in claim 1, which comprises a main body that defines the first guide means, wherein the main body is formed from plastic.

19. A tool as claimed in claim 18, wherein the main body is formed by extrusion.

* * * * *